US009121170B2

(12) United States Patent
Lopez

(10) Patent No.: US 9,121,170 B2
(45) Date of Patent: Sep. 1, 2015

(54) FRAMEWORK FOR STRUCTURAL USE

(75) Inventor: Luis Adell Lopez, Coslada Madrid (ES)

(73) Assignee: GEO-HIDROL, S.A., Coslada, Madrid (ES)

( * ) Notice: Subject to any disclaimer, the term of this patent is extended or adjusted under 35 U.S.C. 154(b) by 0 days.

(21) Appl. No.: 14/114,341

(22) PCT Filed: Apr. 29, 2011

(86) PCT No.: PCT/ES2011/070310
§ 371 (c)(1),
(2), (4) Date: Feb. 6, 2014

(87) PCT Pub. No.: WO2012/146793
PCT Pub. Date: Nov. 1, 2012

(65) Prior Publication Data
US 2014/0165494 A1 Jun. 19, 2014

(51) Int. Cl.
*E04B 2/62* (2006.01)
*E04C 3/08* (2006.01)
*E04C 5/065* (2006.01)
*E04B 2/02* (2006.01)

(52) U.S. Cl.
CPC ... *E04B 2/62* (2013.01); *E04C 3/08* (2013.01); *E04C 5/065* (2013.01); *E04B 2002/0282* (2013.01)

(58) Field of Classification Search
CPC ..... E04B 2/62; E04B 2002/0282; E04C 3/08; E04C 5/065
USPC ..... 52/633, 644
See application file for complete search history.

(56) References Cited

U.S. PATENT DOCUMENTS

| | | | | | |
|---|---|---|---|---|---|
| 1,430,152 | A | * | 9/1922 | Bretschneider | 112/90 |
| 2,300,181 | A | * | 10/1942 | Spaight | 52/712 |
| 2,427,401 | A | * | 9/1947 | Gillberg | 52/633 |
| 2,676,482 | A | | 4/1954 | Wilson | |
| 2,929,238 | A | | 3/1960 | Kaye | |
| 3,059,380 | A | * | 10/1962 | Holsman | 52/694 |
| 3,183,628 | A | * | 5/1965 | Smith | 52/694 |
| 3,347,007 | A | * | 10/1967 | Hale | 52/380 |
| 3,429,091 | A | * | 2/1969 | Dundr | 52/639 |
| 3,559,355 | A | * | 2/1971 | Day, Jr. | 52/251 |

(Continued)

FOREIGN PATENT DOCUMENTS

ES 2148537 10/2000

OTHER PUBLICATIONS

International Search Report, Jan. 20, 2012.

*Primary Examiner* — Mark Wendell
*Assistant Examiner* — Keith Minter
(74) *Attorney, Agent, or Firm* — Greer, Burns & Crain Ltd.

(57) ABSTRACT

A reinforcement for structural use including two longitudinal bars or plates connected by transverse bars or plates. The end sections of each side of the transverse bars or plates end at the longitudinal bars or plates. The longitudinal bars or plates extend laterally from both ends forming corresponding ending areas where there are no transverse bars or plates between the longitudinal bars or plates. At least two of the ends of the longitudinal bar or plate assembly have an inclined section that switches direction toward the respective end and toward the longitudinal bar or plate facing it, and then a section parallel to the opposing longitudinal bar or plate. The ends of the longitudinal bars or plates include elbows folded inward.

6 Claims, 3 Drawing Sheets

(56) References Cited

U.S. PATENT DOCUMENTS

| | | | | |
|---|---|---|---|---|
| 3,785,109 | A * | 1/1974 | Letourneur | 52/633 |
| 3,844,083 | A * | 10/1974 | Farley, Jr. | 52/645 |
| 4,104,842 | A * | 8/1978 | Rockstead et al. | 52/649.1 |
| 4,336,676 | A * | 6/1982 | Artzer | 52/309.7 |
| 5,398,470 | A * | 3/1995 | Ritter et al. | 52/309.11 |
| 5,915,745 | A | 6/1999 | Looverie et al. | |
| 6,199,344 | B1 | 3/2001 | Looverie et al. | |
| 6,553,736 | B2 * | 4/2003 | Montanaro et al. | 52/633 |
| 6,691,486 | B1 * | 2/2004 | Durand | 52/645 |
| 6,789,365 | B1 * | 9/2004 | Hohmann et al. | 52/565 |
| 7,082,707 | B2 * | 8/2006 | Poot | 40/612 |
| 7,162,845 | B2 * | 1/2007 | Messiqua | 52/404.1 |
| 8,051,619 | B2 * | 11/2011 | Hohmann, Jr. | 52/677 |
| 8,667,754 | B2 * | 3/2014 | Schalla et al. | 52/362 |
| 2003/0029123 | A1 * | 2/2003 | Pignataro | 52/712 |
| 2004/0144055 | A1 * | 7/2004 | Lewison | 52/633 |
| 2004/0182029 | A1 * | 9/2004 | Berg | 52/379 |
| 2004/0216404 | A1 * | 11/2004 | Black | 52/250 |
| 2005/0011156 | A1 * | 1/2005 | Tseng | 52/633 |
| 2005/0016111 | A1 * | 1/2005 | Knepp et al. | 52/633 |
| 2005/0108975 | A1 * | 5/2005 | Masterson et al. | 52/633 |
| 2005/0115186 | A1 * | 6/2005 | Jensen et al. | 52/633 |
| 2005/0144884 | A1 * | 7/2005 | Moriya | 52/633 |
| 2006/0032178 | A1 * | 2/2006 | Jensen | 52/633 |
| 2006/0137282 | A1 * | 6/2006 | Anvick et al. | 52/649.1 |
| 2006/0185310 | A1 * | 8/2006 | Wegler | 52/633 |
| 2006/0283129 | A1 * | 12/2006 | Salhaney | 52/633 |
| 2007/0039276 | A1 * | 2/2007 | Sorensen | 52/633 |
| 2007/0125030 | A1 * | 6/2007 | Hoffmann et al. | 52/633 |
| 2007/0261355 | A1 * | 11/2007 | Carlisle et al. | 52/633 |
| 2008/0184653 | A1 * | 8/2008 | Bauman et al. | 52/651.01 |
| 2010/0018148 | A1 * | 1/2010 | Trojer et al. | 52/578 |
| 2013/0125496 | A1 * | 5/2013 | Herion et al. | 52/634 |
| 2015/0047294 | A1 * | 2/2015 | Adell Lopez | 52/836 |

* cited by examiner

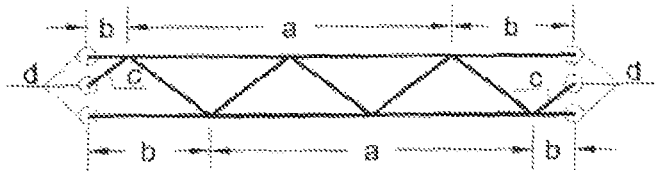
PRIOR ART - FIG. 1
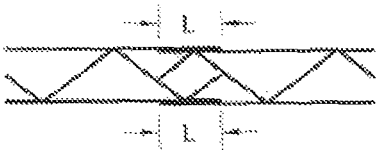
PRIOR ART - FIG. 2
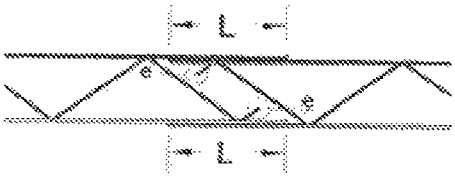
PRIOR ART - FIG. 3

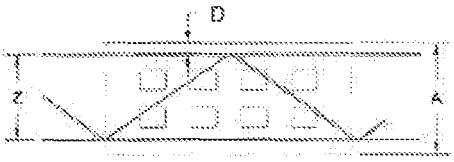
PRIOR ART- FIG.4A
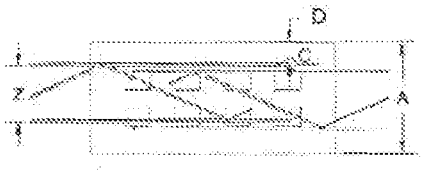
PRIOR ART- FIG. 4B
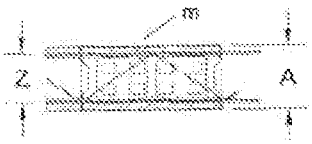
PRIOR ART- FIG. 5A
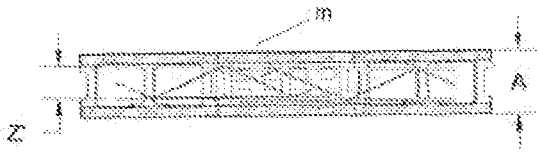
PRIOR ART - FIG. 5B
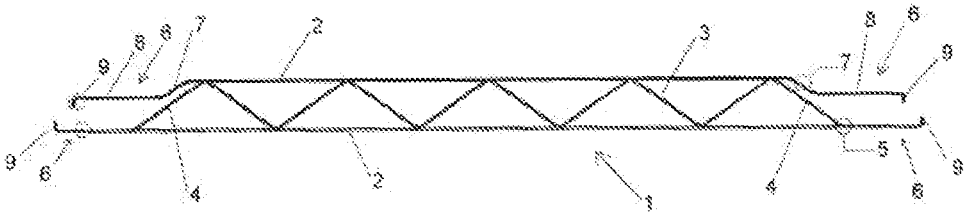
FIG. 6

FRAMEWORK FOR STRUCTURAL USE

CROSS-REFERENCES TO RELATED APPLICATIONS

This application is a national phase of International Application PCT/ES2011/070310 filed Apr. 29, 2011, designating the United States and published on Nov. 1, 2012 as WO 2012/146793.

FIELD OF THE INVENTION

This invention involves a reinforcement for structural use, similar to those which are embedded in masonry wall bed joints. This reinforcement has a structural purpose related to the mechanical behavior of the wall where it is installed.

BACKGROUND OF THE INVENTION

Prefabricated reinforcements that are used for embedding in masonry wall bed joints (also known as "bed joint reinforcements") and which are intended to improve the mechanical performance of walls, consist of two longitudinal steel bars or plates connected at given distances by other transverse bars or plates, or by a continuous plate forming a triangular lattice.

The joint reinforcements currently on the market come in various geometrical configurations, but their geometry always remains constant throughout the piece, keeping the same position, even at the ends.

Thus, for example, the applicant's GEOFOR® standard reinforcement belongs to the triangular lattice group. The unique characteristic of this arrangement is that the reinforcement cannot be deformed on its plane. This provides a crucial advantage for the component's mechanical performance by making it resistant to perpendicular forces from the wall along its plane, regardless of the contribution of the mortar in which it is embedded.

This unique characteristic of reinforcements with triangular lattice shapes remains the same across the entire piece up to the joints at the ends which represent the first and last triangulation. Conversely, in the case of the ends of parts made up of segments of non-triangular bars, their capacity to transmit forces to the system as a whole depends on the mortar that surrounds them. Precisely at the ends of the pieces, and only at their ends, it is necessary for there to be mortar that is properly covered in order to prevent the system from deforming, and to transmit the forces along the length of the wall.

When reinforcements are assigned a structural role in order to increase the mechanical properties of the wall in which they are installed, the possibility of transmitting forces is entrusted to the overlaps of each component they border. Therefore, the end conditions are particularly designed for this purpose. On the other hand, the bars are cut after the steel wire is galvanized, so that the ends of the parts' cut sections are left without proper protection.

As for the overlaps of the reinforcements, it is not possible to superimpose them vertically because the dimensions established for their thickness do not provide for the possibility of properly coating the bars with a suitable mortar that would make it possible to transmit the forces. Therefore, the overlapping is installed along the same plane, connected to the end of a contiguous component.

In addition to a decrease in the performance of the overlapping reinforcement, the overlapping process also entails a series of drawbacks:

1. The need to manipulate the components on site. In order for the overlap to have the minimum required length (around 250 mm), shears need to be used to make at least one diagonal cut at the end of each piece. The cut sections, in turn, represent new unprotected points that run the risk of corrosion.

2. Decrease in the mortar covering. The set of overlapping bars must be covered with enough mortar between them to properly transmit the forces for which they are designed. This entails a decrease in the nominal covering in comparison to the lateral edge of the wall around the overlap areas. The problem is exacerbated because it is precisely at the overlap areas where the cut sections of the reinforcements lie—where the steel is unprotected. It is important to note here that if the wall reinforcement is protected, it is sufficient to have a 15 mm lateral covering, but if bare steel is used, then standards require a minimum covering of 30 mm from any point on the edge of the wall's exterior.

3. Decreased resistance in the wall. In order to adhere to the minimum coverage specified by standards as a protection requirement, the lateral edges of wall reinforcements in overlapping areas must have narrower reinforcement than what would be viable in a center area. This entails a proportional decrease in the reinforced wall's resistance to lateral forces.

4. The impracticality of meeting the minimum covering requirement in hollow reinforcement assemblies. In hollow reinforcement assemblies the reinforcement must have a minimum width in order to be housed in the external band of the mortar. This situation is incompatible with the minimum coating requirement for reinforcements in overlap areas.

The difficulty in simultaneously meeting the requirements for length and overlap covering in reinforcement overlaps, combined with the geometry and dimensions of the masonry components in use restricts the possibility of assigning structural tasks to the wall reinforcement, and this substantially decreases the manufacturer's conditions for protecting the system from external exposure.

SUMMARY OF THE INVENTION

The goal of this invention is to create a reinforcement for structural use for embedding in masonry wall bed joints that will be able to overcome the drawbacks of the proposals of the prior art, while also fulfilling the following objectives:

1. Properly transmitting forces between each reinforcement and those contiguous to it, which is crucial for assigning structural functions to reinforcements.

2. Ensuring the reinforcements will be properly covered at their ends, making cumbersome manipulation of components on site unnecessary.

3. Solving the lack of protection against corrosion at the cut-off ends of the bars.

The invention involves creating a reinforcement for structural use that comprises two longitudinal plates connected by transverse bars or plates, in which:

- the end sections of each side of the transverse bars or plates end at the longitudinal bars or plates,
- the longitudinal bars or plates extend laterally from both ends, forming various ending areas where there are no transverse bars or plates between the longitudinal bars or plates.
- at least two of the ends of the longitudinal bar or plate assembly have an inclined section that switches direction toward the respective end and toward the longitudinal bar or plate facing it, and then have a section parallel to the opposing longitudinal bar or plate, and
- the ends of the longitudinal bars or plates comprise elbows folded inward.

By having this shape in the area at its ends, the reinforcement for structural use is able to provide the exact configuration necessary for properly transmitting forces and providing sufficient protection, all with the goal of improving the structural function of the reinforcement and making manipulating it on site unnecessary.

Other advantageous embodiments of the invention are set out in the dependent claims.

BRIEF DESCRIPTION OF THE DRAWINGS

The subject of this invention will be illustrated below in a non-restrictive manner, by making reference to the accompanying drawings, in which:

FIG. 1 shows a plan view of a triangle lattice wall reinforcement designed with the prior art.

FIG. 2 shows a plan view of two overlapped triangle lattice wall reinforcements designed with the prior art, together with their overlap lengths.

FIG. 3 shows a plan view of two overlapped triangle lattice wall reinforcements designed with the prior art, with their overlap lengths increased.

FIG. 4A shows a plan view of a wall reinforcement from the prior art over masonry components, indicating the distance of the reinforcement from the lateral side of the wall formed by the components.

FIG. 4B shows a plan view of two wall reinforcements from the prior art over overlapping masonry components, indicating the distance of the reinforcements from the lateral side of the wall in the overlap area.

FIG. 5A shows a plan view of a wall reinforcement from the prior art in a hollow reinforcement assembly, indicating the distance of the reinforcement from the lateral side and the lateral bands of the mortar.

FIG. 5B shows a plan view of two wall reinforcements from the prior art, overlapped in a hollow reinforcement assembly, indicating the distance of the reinforcements from the lateral side and the lateral bands of the mortar.

FIG. 6 shows a plan view of the reinforcement embodiment for structural use of the invention.

DETAILED DESCRIPTION OF THE PREFERRED EMBODIMENTS

Figure 7:
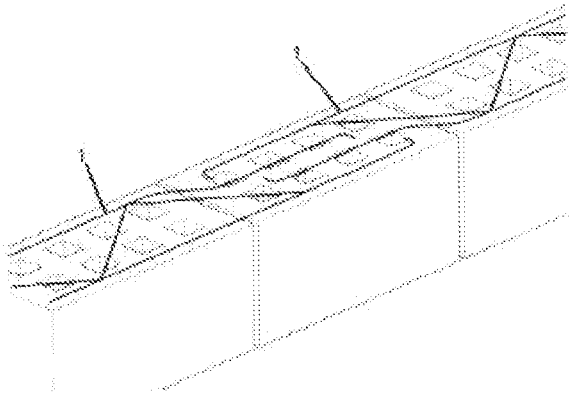
FIG. 7 shows a perspective view of the two reinforcements for structural use from FIG. 6, overlapped and installed over masonry components.

FIGS. 1-5B show configurations with bed reinforcement from the prior art with triangle lattice.

FIG. 1 shows a standard, triangle lattice shaped bed reinforcement. Here a triangular area can be seen, the plane of which cannot be deformed. Force is transmitted by the reinforcement itself (indicated by the letter 'a'). It has non-triangulated anchor areas and the forces are transmitted by adherence to the mortar (indicated by the letter 'b'). It also shows a series of diagonal segments at the end, which are inert for mechanical performance (indicated by the letter 'c'), and cut sections of the reinforcement (indicated by the letter 'd') which are unprotected against corrosion.

FIG. 2 shows a plan view of two overlapped triangle lattice bed reinforcements designed with the prior art, together with their overlap lengths. In these figures the overlapping is installed along the same plane, connected to the end of a contiguous component. In this figure, the maximum possible overlap length without cutting the reinforcements is marked as 'L'.

FIG. 3 shows a plan view of two overlapped bed reinforcements designed with the prior art, with their overlap length (L) increased. This overlap length is necessary for transmitting forces; therefore, shears are used on site to make at least one diagonal cut at each end of the piece (indicated as 'e' in the figure).

FIG. 4A shows a plan view of a bed reinforcement from the prior art on masonry components, indicating the distance (D) of the reinforcement from the lateral side of the wall formed by the components. This reinforcement is made of protected steel, so a minimum lateral covering of 15 mm is sufficient. The width of the masonry piece is marked as 'A' and the nominal width of the reinforcement is marked as 'Z'.

FIG. 4B shows a plan view of two bed reinforcements from the prior art, overlapping masonry components, indicating the distance (D) of the reinforcements from the lateral side of the wall in the overlap area. These reinforcements are made of protected steel, but their cut sections are made of unprotected steel. A minimum lateral covering of 30 mm is therefore needed. The width of the masonry piece is marked as 'A', the nominal width of the reinforcement is marked as Z, and the unprotected cut section is marked as 'C'. It can also be noted in the figure that in order to adhere to the minimum coverings specified by standards as a protection requirement, the lateral edges of bed reinforcements in overlapping areas must have narrower reinforcement than what would be viable in a center area.

FIG. 5A shows a bed reinforcement from the prior art in a hollow bed reinforcement assembly, indicating the distance from the reinforcement to the lateral edge and the lateral bands of mortar, (m). In hollow reinforced walls, the mortar in the reinforcements is installed in two bands (m) located alongside the wall faces, and the center area is left hollow, as can be seen in the figure. The width of the masonry piece is marked as 'A', and the reinforcement width compatible with the piece in order for it to enter into the mortar band (m) is marked as Z. Hollow reinforced bed assemblies must have a minimum width for the reinforcement to be installed in the outer band of mortar (m). With its two bed reinforcement assemblies from the prior art, FIG. 5B shows how this situation is incompatible with the minimum coverage reinforcements must have in their overlap areas. The required protection width is marked as Z', which is incompatible with the width of the piece, because it does not fit in the band of mortar (m).

FIGS. 6 and 7 show an embodiment of the reinforcement 1 for structural use of the invention. It comprises a reinforcement 1 that is symmetrical to its average transversal plan, making it possible to overlap reinforcements 1 comprising entire components, with this use being appropriate for use in long walls or modular walls.

The following characteristics of the reinforcement 1 can be seen in this figure:

- the end sections 4 of each side of the transverse bars or plates 3 end at the longitudinal bars or plates 2,
- the longitudinal bars or plates 2 are extended laterally from both ends beyond the end sections 4 of the transverse bars or plates 3 forming corresponding ending areas 6 where there are no transverse bars or plates 3 between the longitudinal bars or plates 2,
- at least two of the ends of the longitudinal bar or plate 2 assembly have an inclined section 7 that switches or changes direction toward its respective end and is angled toward the longitudinal bar or plate 2 facing it, and then a section 8 parallel to the opposing longitudinal bar or plate 2, and the ends of the longitudinal bars or plates 2 comprise elbows 9 folded inward.

More specifically, in the embodiment in FIGS. 6 and 7, one of the longitudinal bars or plates 2 is shorter than the other and has an inclined section 7 at each end that changes direction toward the tip of the respective end and toward the opposite longitudinal bar or plate 2

FIG. 7 shows how the two contiguous reinforcements 1 from FIG. 6 overlap when installed over masonry components 10.

Figure 8:
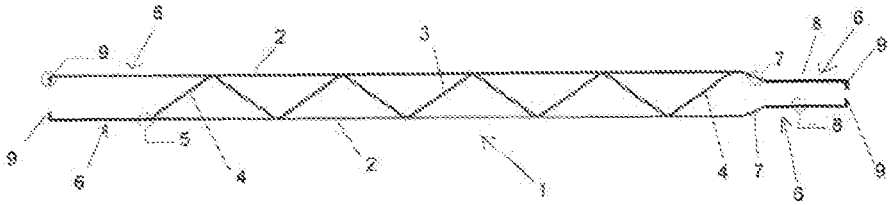
FIG. 8 shows a plan view of an alternative embodiment for the reinforcement for structural use of the invention.

FIG. 8 shows a second plan view of the reinforcement embodiment for structural use of the invention. It is a reinforcement 1 that is symmetrical to its longitudinal plane, allowing the whole components and the cut components to overlap. This format can be applied in any continuous reinforced bed wall, and is particularly well suited for singular, non-modular elements or shorter elements such as hollow lintels.

The following characteristics of the reinforcement 1 can also be seen in this figure:

the end sections 4 of each side of the transverse bars or plates 3 end at the longitudinal bars or plates 2, the longitudinal bars or plates 2 are extended laterally from both ends forming various ending areas 6 where there are no transverse bars or plates 3 between the longitudinal bars or plates 2, at least two of the ends of the longitudinal bar or plate assembly 2 have an inclined section 7 that switches direction toward the respective end and toward the longitudinal bar or plate 2 facing it, and then a section 8 parallel to the opposing longitudinal bar or plate 2, and the ends of the longitudinal bars or plates 2 comprise elbows 9 folded inward.

Figure 9:
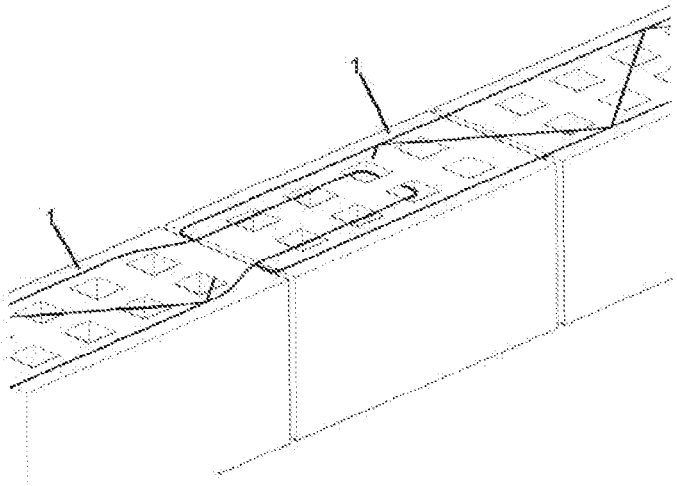
FIG. 9 shows a perspective view of the two reinforcements for structural use from FIG. 8, overlapped and installed over masonry components.

More specifically, in the embodiment in FIGS. 8 and 9, the longitudinal bars or plates 2 are the same length and each of them has an inclined section 7 at each end of the reinforcement 1 that changes direction toward the tip of the respective end and toward the opposite longitudinal bar or plate 2

In FIGS. 6 and 8, the factory-made cut of the excess diagonal section is marked with the number 5. Also shown are the longitudinal bars or plates 2 with their overlap length, where the longitudinal bars or plates 2 change direction to leave space for the covering, and the elbow ending 9 which protects the cut off section.

FIG. 9 shows a perspective view of the two reinforcements for structural use 1 from FIG. 8, overlapped and installed over masonry components 10.

Preferably, the longitudinal bars or plates 2 of the reinforcements 1 of the invention should be connected by a continuous bar or plate, forming a triangular lattice, as shown in FIGS. 6 to 9.

Although some embodiments of the invention have been described and represented, it is clear that modifications comprised in its scope can be introduced and that it must not be considered to be limited to these embodiments, but solely to the contents of the following claims.

The invention claimed is:

1. A reinforcement for structural use comprising two longitudinal bars or plates connected by transverse bars or plates, comprising:

end sections of each side of the transverse bars or plates ending at the longitudinal bars or plates, the longitudinal bars or plates extend laterally from both of their ends forming corresponding ending areas where there are no transverse bars or plates between the longitudinal bars or plates, at least two of the ends of the longitudinal bar or plate assembly have an inclined section that switches direction toward the respective end and toward the opposing longitudinal bar or plate, and then a section parallel to the opposing longitudinal bar or plate, and the ends of the longitudinal bars or plates comprise elbows folded inward with the ends extending toward the opposing longitudinal bar or plate.

2. The reinforcement for structural use as in claim 1, wherein it is symmetrical to its average transversal plan.

3. The reinforcement for structural use as per claim 2, wherein one of the longitudinal bars or plates is shorter than the other and has an inclined section at each end that changes direction toward the tip of the respective end and toward the opposite longitudinal bar or plate.

4. The reinforcement for structural use as in claim 1, wherein it is symmetrical to its middle longitudinal plan.

5. The reinforcement for structural use as in claim 4, wherein the longitudinal bars or plates are the same length and each of them has an inclined section at one end of the reinforcement that changes direction toward the tip of the respective end and toward the opposite longitudinal bar or plate.

6. The reinforcement for structural use as in claim 1, wherein the longitudinal bars or plates are connected by a continuous bar or plate, forming a triangular lattice.

* * * * *